US012410609B2

(12) United States Patent
Theberge et al.

(10) Patent No.: US 12,410,609 B2
(45) Date of Patent: Sep. 9, 2025

(54) STRUCTURAL FIRE- AND WATER-RESISTANT PANELS, AND MANUFACTURING METHODS THEREFOR

(71) Applicant: Huber Engineered Woods LLC, Charlotte, NC (US)

(72) Inventors: Jean Pascal Theberge, Jefferson, GA (US); Trevor Ronson Rajopa, Comer, GA (US); Karttikay Moudgil, Johns Creek, GA (US); Winford Terry Liles, Commerce, GA (US)

(73) Assignee: Huber Engineered Woods LLC, Charlotte, NC (US)

( * ) Notice: Subject to any disclaimer, the term of this patent is extended or adjusted under 35 U.S.C. 154(b) by 687 days.

(21) Appl. No.: 17/532,115

(22) Filed: Nov. 22, 2021

(65) Prior Publication Data

US 2022/0195724 A1 Jun. 23, 2022

Related U.S. Application Data

(60) Provisional application No. 63/235,905, filed on Aug. 23, 2021, provisional application No. 63/126,599, filed on Dec. 17, 2020.

(51) Int. Cl.

| | |
|---|---|
| ***E04B 1/94*** | (2006.01) |
| ***E04B 1/66*** | (2006.01) |
| ***E04B 9/04*** | (2006.01) |
| ***E04B 9/16*** | (2006.01) |
| ***E04B 9/36*** | (2006.01) |
| ***E04C 2/10*** | (2006.01) |
| ***E04C 2/296*** | (2006.01) |

(52) U.S. Cl.

CPC ..... *E04B 1/942* (2013.01); *E04B 1/665* (2013.01); *E04B 9/045* (2013.01); *E04B 9/16* (2013.01); *E04B 9/366* (2013.01); *E04C 2/10* (2013.01); *E04C 2/296* (2013.01)

(58) Field of Classification Search

None

See application file for complete search history.

(56) References Cited

U.S. PATENT DOCUMENTS

| | | | | |
|---|---|---|---|---|
| 2,692,219 | A | 10/1954 | Slayter et al. | |
| 3,984,596 | A | 10/1976 | Failmezger | |
| 4,292,364 | A | 9/1981 | Wesch et al. | |
| 4,315,967 | A | 2/1982 | Prior et al. | |
| 4,528,238 | A * | 7/1985 | Alford | B28B 1/52 442/256 |
| 5,102,726 | A | 4/1992 | Gabbay | |
| 5,220,762 | A | 6/1993 | Lehnert et al. | |
| 5,397,631 | A | 3/1995 | Green et al. | |
| 5,733,633 | A | 3/1998 | Lin | |
| 6,221,521 | B1 | 4/2001 | Lynn et al. | |
| 6,893,752 | B2 | 5/2005 | Veeramasuneni et al. | |
| 7,049,251 | B2 | 5/2006 | Porter | |
| 7,300,892 | B2 | 11/2007 | Porter | |
| 7,641,764 | B2 | 1/2010 | Yoshida et al. | |
| 7,740,700 | B2 | 6/2010 | Wallner | |
| 7,998,547 | B2 | 8/2011 | Feigin et al. | |
| 8,070,895 | B2 | 12/2011 | Engbrecht et al. | |
| 8,092,858 | B2 | 1/2012 | Smith | |
| 8,461,067 | B2 | 6/2013 | Smith et al. | |
| 8,568,544 | B2 | 10/2013 | Engbrecht et al. | |
| 9,879,426 | B2 | 1/2018 | Tilford | |
| 10,208,413 | B2 | 2/2019 | Paradis et al. | |
| 10,336,036 | B2 | 7/2019 | Dubey et al. | |
| 10,344,478 | B2 | 7/2019 | Foster et al. | |
| 10,399,898 | B2 | 9/2019 | Peng et al. | |
| 10,562,271 | B2 | 2/2020 | Shake et al. | |
| 10,906,271 | B2 | 2/2021 | Shake et al. | |
| 11,267,227 | B2 | 3/2022 | Shake et al. | |
| 2004/0209074 | A1 | 10/2004 | Randall et al. | |
| 2006/0292358 | A1 | 12/2006 | Robertson et al. | |
| 2010/0143682 | A1 | 6/2010 | Shake et al. | |
| 2010/0152332 | A1 * | 6/2010 | Lecomte | C04B 20/1051 428/404 |
| 2011/0256372 | A1 * | 10/2011 | Hauber | B32B 5/022 428/218 |
| 2013/0115835 | A1 | 5/2013 | Voit et al. | |
| 2014/0057066 | A1 | 2/2014 | Cai | |
| 2015/0052838 | A1 * | 2/2015 | Ritchie | E04C 3/29 156/331.7 |
| 2015/0064433 | A1 | 3/2015 | Foster et al. | |
| 2015/0314564 | A1 | 11/2015 | Mancini et al. | |

(Continued)

FOREIGN PATENT DOCUMENTS

| | | |
|---|---|---|
| AU | 2014228187 | 9/2014 |
| WO | 2015085807 | 6/2015 |

(Continued)

OTHER PUBLICATIONS

Merriam-Webster, definition of "structural", date accessed: Jan. 7, 2025 <https://www.merriam-webster.com/dictionary/structural> (Year: 2025).*

(Continued)

*Primary Examiner* — Cheng Yuan Huang

(74) *Attorney, Agent, or Firm* — Perilla Knox & Hildebrandt LLP

(57) ABSTRACT

A core/base layer, an intermediate layer, a divider layer between the core and intermediate layers, and a water-resistant layer on the intermediate layer opposite the core layer. The core and intermediate layers are made of a cementitious material to provide structural-strength and fire-resistance properties, with the core layer including an aggregate material for added strength, the intermediate layer including an hydrophobic additive for water resistance, and the divider layer positioned between the core and intermediate layers to form a physical barrier that prevents cross-migration of the aggregate material and the hydrophobic additive between these layers. The water-resistant layer includes a fiber-based carrier layer with an outward-facing surface having a weather barrier layer secured to it and with an opposite uncoated inward-facing surface having loose fiber strands extending from it and embedded into the intermediate layer to secure the water-resistant layer to the intermediate layer.

20 Claims, 9 Drawing Sheets

(56) References Cited

U.S. PATENT DOCUMENTS

| | | | | |
|---|---|---|---|---|
| 2017/0284093 | A1 | 10/2017 | Lai et al. | |
| 2019/0010697 | A1 | 1/2019 | Thomas et al. | |
| 2019/0023886 | A1* | 1/2019 | Crouch | C08K 3/346 |
| 2019/0330846 | A1* | 10/2019 | Peng | B32B 5/022 |
| 2020/0240143 | A1 | 7/2020 | Teng et al. | |

FOREIGN PATENT DOCUMENTS

| | | |
|---|---|---|
| WO | 2018136022 | 7/2018 |
| WO | 2018195599 | 11/2018 |
| WO | 2019113555 | 6/2019 |

OTHER PUBLICATIONS

Georgia-Pacific, "Advanced Technology Meets Intelligent Design", published at least by Dec. 17, 2020, 2 pages.
Georgia-Pacific, "Real-World Proven Performance Through Innovation", published at least by Dec. 17, 2020, 3 pages.
USG, "Securock ExoAir 430 System", 2020, 8 pages.

* cited by examiner

STRUCTURAL FIRE- AND WATER-RESISTANT PANELS, AND MANUFACTURING METHODS THEREFOR

CROSS-REFERENCE TO RELATED APPLICATIONS

This application claims the priority benefit of U.S. Provisional Patent Application Ser. No. 63/235,905, filed Aug. 23, 2021, and U.S. Provisional Patent Application Ser. No. 63/126,599, filed Dec. 17, 2020, which are hereby incorporated by reference herein for all purposes.

TECHNICAL FIELD

The present invention relates generally to panels for use in building construction, and particularly to such panels that are structural, fire-resistant, and water-resistant.

BACKGROUND

Sustainability in building enclosures is a major focus of innovation and technology in the building industry. Energy conservation, urbanization, and the optimization of common resources have all led to major changes in building practices in the last decade. From an architectural and engineering standpoint, building codes have led to major innovations in efforts to address the current needs in protecting buildings against fire, water intrusion, and energy waste.

From a fire-protection standpoint, gypsum panels have been used for many decades. But they lack structural strength, which is required in structural applications. Therefore, bracing and other building modifications are used to provide structural strength for gypsum panels. But these types of modifications tend to be complicated and cumbersome.

In addition to the need for fire-protection and structural strength, water intrusion is often a significant problem that architects and engineers must consider in their designs. To protect a building against water intrusion, building enclosures typically include a water-resistant element in their design. For example, weather-resistive barriers (WRBs) are typically used to provide protection against water infiltration and energy loss, with the WRBs installed over the building panels on-site by water-proofing contractors. Adding a water-resisting element can help mitigate water issues but often results in complications and system failures, for example caused by incompatibility between materials, improper waterproofing application, and improper architectural design.

When these various building products are assembled together on-site to provide structural integrity, fire resistance, and water proofing for a building enclosure, another important consideration is energy and moisture flow. If energy and moisture flow are not properly addressed, a building can suffer a major failure if the components are not properly integrated to address condensation or energy loss.

The successful integration of all these elements for providing structural integrity, fire resistance, water-resistance, and energy and moisture flow for a building enclosure is critical to building performance. While current building-enclosure technology has improved over the years, further advances are desired for providing better building performance.

Accordingly, it can be seen that needs exist for improvements in building-construction panels for constructing building enclosures. It is to the provision of solutions meeting these and other needs that the present invention is primarily directed.

SUMMARY

Generally described, the present invention relates to building-construction panels that provide structural, fire-resistance, and water-resistance properties. In typical embodiments, the panels include a core/base layer, an intermediate layer, a divider layer between the core and intermediate layers, and a water-resistant layer on the intermediate layer opposite the core layer. The core layer and the intermediate layer are made of a cementitious material to provide structural-strength and fire-resistance properties, with the core layer including an aggregate material for added strength, the intermediate layer including a hydrophobic additive for water resistance, and the divider layer positioned between the core and intermediate layers to form a physical barrier that prevents cross-migration of the aggregate material and the hydrophobic additive between the core and intermediate layers. The water-resistant layer has water-resistance properties and includes a fiber-based carrier layer with an outward-facing surface having a weather barrier layer secured to it and with an opposite inward-facing surface that is uncoated to form an open backer with loose fiber strands extending therefrom and embedded into the intermediate layer to secure the water-resistant layer to the intermediate layer. The panel can be provided with a number of variations in design and construction including but not limited to the example embodiments described herein.

The specific techniques and structures employed to improve over the drawbacks of the prior art and accomplish the advantages described herein will become apparent from the following detailed description of example embodiments and the appended drawings and claims.

DETAILED DESCRIPTION OF EXAMPLE EMBODIMENTS

The present invention relates to structural fire-resistant and water-resistant panels and manufacturing methods for making such panels. The panels are designed for use in constructing building enclosures (aka envelopes) of buildings. As such, the panels are typically installed (e.g., by nails or other fasteners) on frame structures such as wall framing systems (e.g., including wall studs), roof framing systems (e.g., including roof rafters), and/or floor framing systems (e.g., including floor joists) to construct panelized wall sheathing, roof decking, and subfloor systems for sheathing and enclosing the constructed building. Typically, exterior cladding (e.g., EIFS, brick, stucco, lap siding, or vinyl siding) is installed over the structural wall sheathing panels to provide the finished wall system, exterior roofing (e.g., roof shingles or tiles) is installed over the structural roof decking panels to provide a finished roof system, and/or internal floor covering (e.g., carpet, tile, or hardwood) is installed over the structural sub-floor panels to provide a finished floor surface. The panels can be used for forming only a portion of the building enclosure, for example only the walls, as may be desired in some building designs. The panels can also be used to construct other types of enclosures or protective barriers in other applications. The panels can be provided in various compositions with layers placed strategically to provide synergy and functionality (e.g., mechanical strength, water repellency, and additive integration) between each layer to result in enhanced overall performance.

Figure 1:
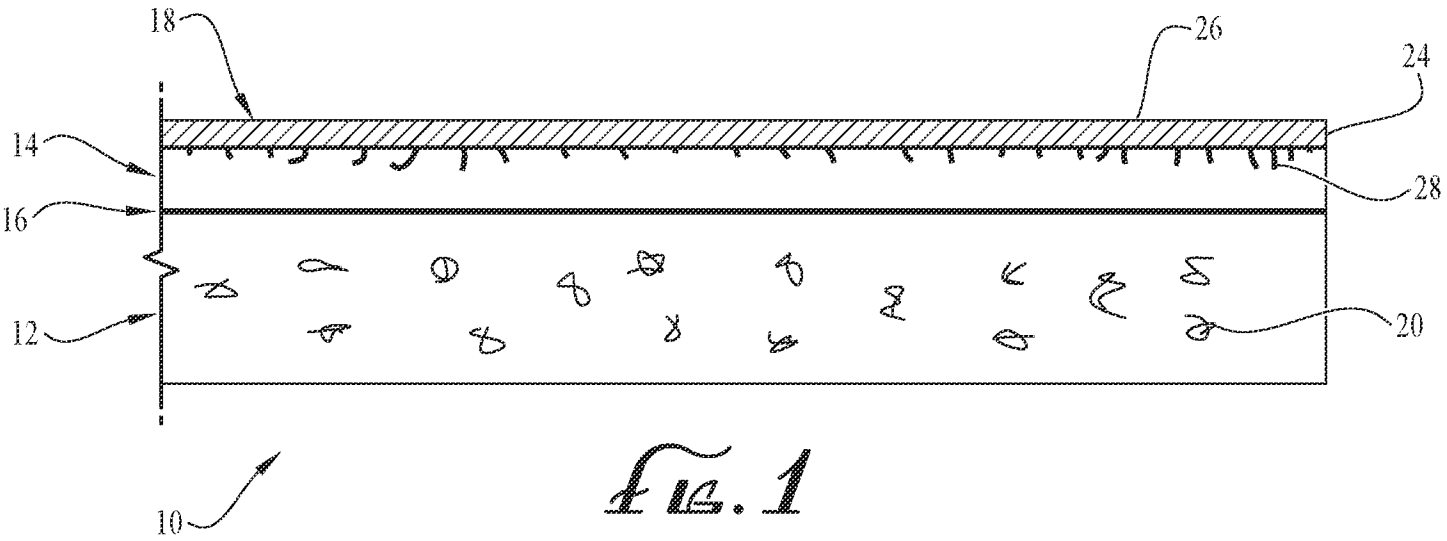
FIG. 1 is a side cross-sectional view of a portion of a structural fire- and water-resistant panel according to a first example embodiment of the invention.

Referring now to the drawing figures, FIG. 1 shows a structural fire-resistant water-resistant panel 10 according to a first example embodiment. The panel 10 includes a core (aka base) layer 12, an intermediate layer 14, a divider layer 16 between the core and intermediate layers 12 and 14, and a water-resistant layer 18 on the intermediate layer 14 opposite the core layer 12. When installed for use, the panel 10 is typically oriented and positioned with the core layer 12 facing inward (e.g., downward for forming a roof system) and the water-resistant layer 18 facing outward (e.g., upward for forming a roof system) so that the water-resistant layer 18 protects the interior of the building enclosure, and the other portions of the panel 10, from the intrusion of moisture.

The core layer 12 is structural and fire-resistant, and thus is made of a material selected for providing these properties. In example embodiments, the core layer 12 includes a cementitious material, such as magnesium oxide. In other embodiments, the core layer 12 includes a different cementitious material and/or a different type of material selected for providing the structural and fire-resistant properties of the panel 10. For example, the core layer 12 can optionally include an inorganic material such as Portland cement, slag cement, calcium or magnesium sulfate material, fly ash cement, calcium alumina cement, or a mixture of some or all of these cementitious materials.

The panel 10 is a structural panel (i.e., with load-bearing properties), for example rated PS 2 by the American Plywood Association (APA). Thus, the core layer 12 by itself is typically a structural layer. In some embodiments, the combination of the core and intermediate layers 12 and 14, or the overall panel 10 (i.e., the combination of all its layers), together provide the structural properties. In other embodiments, the core layer and/or panel is structural but with a lower load-bearing rating (e.g., PS 1). In still other embodiments, the core layer and/or panel is not structural and can be used for non-structural applications such as non-load bearing walls where gypsum is typically used.

Also, the panel 10 is a fire-resistant panel. Thus, the core layer 12 by itself is typically a fire-resistant layer. In some embodiments, the combination of the core and intermediate layers 12 and 14, or the overall panel 10 (i.e., the combination of all its layers), together provide the fire-resistant properties. For example, the core layer 12 by itself, the combination of the core and intermediate layers 12 and 14, and/or the overall panel 10, is typically rated "non-combustible" and/or is typically rated "fire-resistant Class A," which is the highest rating per ASTM E84, which is an international standard that defines surface burning characteristics of building materials based on flame spread and smoke development.

The core layer 12 typically does not have another layer secured to it on the major surface opposite the divider layer 16, and thus in the present embodiment can be referred to as the bottom or base layer. In other embodiments, the panel has another layer secured to the core layer on the major surface opposite the divider layer 16 (for example, the panel 110 described below).

In the depicted embodiment, the core layer 12 includes magnesium oxide, as previously noted. Magnesium oxide (MgO) is a versatile hygroscopic mineral that has been used in the manufacturing of cement over centuries. When combined with magnesium chloride and water, the resulting material (aka Sorel cement) forms stable oxychlorides under the following formulas:

$3Mg(OH)_2 \cdot MgCl_2 \cdot 8H_2O$(3-phase amorphous or crystalline); and $5Mg(OH)_2 \cdot MgCl_2 \cdot 8H_2O$(5-phase crystalline or amorphous).

The controlled formation of these oxychlorides is significant in the development of the cement and its characteristics. Structural strength is typically well achieved by the formation of the 5-phase crystalline form, which appears in the shape of interlocking needles. As with most cements, the resulting material provides a structurally strong material that can be tailored with various additives and aggregates for many applications. Optionally, the magnesium oxide can be combined with magnesium sulfate, instead of magnesium chloride.

Among the most common dry add or aggregates used in the manufacturing of magnesium oxide panel layers are biomaterials (e.g., wood), perlite, glass fibers, and expanded clays. These aggregates are typically added to provided properties such as increased tensile strength, increased fastener hold/resistance (i.e., the ability to retain nail or other fasteners used to install the panel to the building frame structure), and/or reduced weight and/or density.

Because the properties of magnesium oxide panels are inherently structural and fire-resistant by nature, the core layer 12 of the depicted embodiment is made of a magnesium oxide material to provide a structural and fire-resistant substrate to which a water-resistant solution that can be factory applied to avoid traditional panel waterproofing problems (e.g., architectural design, compatibility, and application). The overall composition of the panel 10 is designed with each of the described elements working in conjunction together with each other, as noted herein.

Accordingly, the core layer 12 of the depicted embodiment includes magnesium oxide (not shown particularly in the drawing figures) and selected additives. These additives include reactive additives (not shown particularly in the drawing figures) such as magnesium chloride (or magnesium sulfate) and water for reacting with the magnesium oxide to provide the desired structural and fire-resistant properties, as noted above.

The core-layer additives typically also include aggregate materials 20 for providing added structural strength and lower density and weight. Example aggregate materials 20 that can be included in the core layer 12 are biomaterials (e.g., wood), perlite, glass fibers, and expanded clays, as noted above, or other particles or matter. In typical embodiments, the aggregates 20 include perlite (to lower density and for fire retardancy properties) and a biomaterial such as wood (to lower density and improve fastener-holding properties).

The intermediate layer 14 is also structural and fire-resistant, and thus is also made of a material selected for providing these properties. In example embodiments, the intermediate layer 14 includes a cementitious material, such as magnesium oxide. In other embodiments, the intermediate layer 14 includes a different cementitious material and/or a different type of material selected for providing the structural and fire-resistant properties of the panel 10, for example an inorganic material such as Portland cement, slag cement, calcium or magnesium sulfate material, fly ash cement, calcium alumina cement, or a mixture of some or all of these cementitious materials.

In the depicted embodiment, the intermediate layer 14 includes magnesium oxide (not shown particularly in the drawing figures) and selected additives. These additives include reactive additives (not shown particularly in the drawing figures) such as magnesium chloride and water for reacting with the magnesium oxide, as noted above. The intermediate-layer additives do not, however, include any aggregates for providing added structural strength and lower density and weight, such as those added to the core layer 12 as described above (or at least any aggregates included are in such minimal proportions that they have only a negligible effect on the structural strength).

The intermediate-layer additives typically also include hydrophobic additives (not shown particularly in the drawing figures) that reduce water ingress and absorption into the cementitious material of the intermediate layer 14 (for any water that might intrude past the water-resistant layer 18). Water intrusion can lead to conditions favorable to mold growth and possible efflorescence or leaching of the magnesium chloride. Example hydrophobic additives that can be included in the intermediate layer 14 are inorganic and/or polymer-based additives such as silicone and/or siloxane products, for example those commercially available as MASTERPEL 200HD (by BASF) and as BS130, BS 60, BS 1042, BS 3003, or Crème C (by Wacker Chemical Corporation, of Adrian, Michigan). In example embodiments, the intermediate layer 14 meets the water-resistant properties defined by test methods such ASTM E2556M, ASTM D5795, and/or ASTM E331, and is substantially impermeable to liquid (bulk) water ingress (to prevent liquid water penetration further into the panel 10 and possibly into the building, or at least to minimize it to a negligible extent) but is permeable to water vapor egress to allow drying (to provide breathability to allow the panel 10 to dry if excess moisture builds up within the panel 10). The addition of such hydrophobic agents, however, can tend to lessen the structural strength of the intermediate layer 14 (relative to the core layer 12, which does not include such hydrophobic additives).

As such, the intermediate layer 14 typically is formulated for providing water resistance properties. Because of the absence (or negligible presence) of any aggregates, the intermediate layer 14 has more resistance to water ingress/absorption and has a more uniform and smooth consistency, resulting in its top surface 20 (opposite the core layer 12) being very even and smooth for improved aesthetics of the finished panel 10. In addition, the inclusion of the hydrophobic additives provides the intermediate layer 14 with some resistance to water ingress/absorption.

In contrast to the intermediate layer 14, which in typical embodiments functions in large part as a second line of defense against water absorption, the core layer 12 has different properties because of the added solid aggregates. The added aggregates such as wood particles and perlite provide fastener-holding capacity (they retain the nails or other fasteners used to install the panels 10 onto the building frame structure). The aggregates also provide significant reductions in density and brittleness, which are undesirable properties for cementitious materials. The intermediate layer 14 and the core layer 12 are thus separate but work together to provide structural strength, fire-resistance and water-resistance. The core layer 12 is designed to provide all, or at least the bulk, of the structural strength, with the intermediate layer 14 providing most, or at least a significant portion, of the water resistance of the panel 10.

As such, the core layer 12 typically has about the same thickness as conventional magnesium oxide structural panels. So, the total thickness of the panel 10 is typically greater than that of conventional magnesium oxide structural panels and is typically about the same or greater than that of conventional magnesium oxide structural panels with field-installed water-resistive elements applied. In typical embodiments, for example, the intermediate layer 14 can have a thickness of about 1/16 inch to about 1/4 inch (depending on the desired properties/application of the panel). The intermediate layer 14 can include for example at least about 5% of the total weight of magnesium oxide slurry (before aggregates or hydrophobic agents are added) used to form the core and intermediate layers 12 and 14 for a panel 10 with a total thickness of about 1/2 inch, and in general for all panel thicknesses the proportion in weight of the intermediate layer 14 can be, for example, about 3 percent to about 30 percent of the total weight of the panel.

The divider layer 16 is positioned between the core layer 12 and the intermediate layer 14 in order to provide physical separation of the core and intermediate layers 12 and 14. As such, the divider layer 16 is made of a material that enables it to function as a physical barrier that prevents cross-migration of the aggregates 20 and the hydrophobic additives between the core and intermediate layers 12 and 14. In example embodiments, the divider layer 16 is made of a material, such as a sheet of fiberglass or polyester (e.g., with a density of about 5 g/cm$^3$ to about 15 g/cm$^3$), that provides this physical barrier functionality. In other embodiments, the divider layer is provided by a sheet of a non-woven or woven material including glass, natural, and/or synthetic fiber polymers such as polypropylene, polyethylene, polyester, polystyrene, rayon, and/or combinations thereof. In some embodiments, the divider layer 16 is also water-resistant (e.g., made of a water-resistant material, or including a water-resistant coating or other treatment) to provide the additional functionality of preventing (at least minimizing to a negligible level) water penetration (for any water that might intrude that far) into the core layer 12.

In this way, the physical separation provided by the divider layer 16 enables the core layer 12 to be formulated to include aggregates 20 to provide higher strength, lower density/weight, and improved machinability (relative to the intermediate layer 14). Thus, this separation prevents migration of the aggregates 20 from the core layer 12 to the intermediate layer 14, which would tend to lessen the water repellency of the intermediate layer 14 and, thus, the overall panel 10. At the same time, this separation allows the intermediate layer 14 to be formulated to include hydrophobic additives to better repel water (relative to the core layer 12). Thus, this separation prevents migration of the hydrophobic additives from the intermediate layer 14 to the core layer 12, which would tend to lessen the overall structural strength of the core layer 12 and thus the overall panel 10.

The water-resistant (or resistive) layer 18 is positioned on and secured to the intermediate layer 14 opposite the core layer 12, so this is typically the outward-facing (otherwise exposed) layer of the panel 10). The water-resistant layer 18 is made of a material selected for providing water-resistant properties. In example embodiments, the water-resistant layer 18 meets the water-resistant properties defined by test methods such ASTM E2556M, ASTM D5795, and/or ASTM E331. In this way, the water-resistant layer 18 is substantially impermeable to liquid (bulk) water ingress into the intermediate layer 14 (to prevent liquid water penetration into the panel 10 and possibly into the building, or at least to minimize it to a negligible extent) but is permeable to water vapor egress from the intermediate layer 14 to allow drying (to provide breathability to allow the panel 10 to dry if excess moisture builds up within the panel 10).

In example embodiments, the water-resistant layer 18 is made of a non-woven fiber-based carrier layer such as a sheet of natural or synthetic fiber material, with a weather barrier 26 on the outward-facing surface (opposite the intermediate layer 14), and with the inward-facing surface (abutting and secured to the intermediate layer 14) being uncoated and thus having an open or closed network of loose fiber strands 28. The fiber-based carrier layer can be made of for example fiberglass, mineral fibers, polymer fibers such as polyester or polypropylene, or a mixture thereof. And the hydrophobic treatment can be a hydrophobic treatment for example a coating of phenolic resin, melamine formaldehyde resin, acrylic or modified acrylic resin, or polyurethane dispersion providing the water-resistant properties.

In the depicted embodiment, the water-resistant layer 18 is a fiberglass sheet 24 with a hydrophobic coating 26 on the outward-facing surface forming a water-resistant fiber-based membrane and with the secured surface abutting the intermediate layer 14 being uncoated. In this way, the fiberglass sheet 24 has an open back/bottom, with its uncoated secured surface having of a plurality of loose strands 28 of the fiberglass material extending from it and into the intermediate layer 14 to help secure the water-resistant layer 18 to the intermediate layer 14 during curing of the intermediate layer 14. An adhesive or other bonding agent can additionally be used to help secure the water-resistant layer 18 to the intermediate layer 14.

With the intermediate layer 14 including magnesium oxide as a primary component material, it's formulated to work in conjunction with the water-resistant fiberglass layer 18, because the fiberglass strands 26 are securely embedded and anchored into, and thus retained by, the intermediate layer 14 when the magnesium oxide slurry is cured during manufacture to securely attach the water-resistant layer 18 to the intermediate layer 14 as an integrated matrix. Also, the combination of the water-resistant layer 18 and the hydrophobic additives of the intermediate layer 14 enables the panel 10 to repel bulk liquid water and at the same time provide water vapor permeability or breathability.

Without the strategic use and placement of the open-backed fiberglass water-resistant layer 18 on the intermediate layer 14, the inclusion of the hydrophobic agents in the intermediate layer 14 would not be practical. This is because highly hydrophobic agents such as silicone, siloxanes, and silicone\siloxane derivatives tend to interfere with adhesives, ink application, leveling agents, sealants, and other surface treatments. That is, the inclusion of an open-backed fiber-based water-resistant layer 18 on the intermediate layer 14 provides two benefits. First, this arrangement enables the embedded-fiber attachment of the two layers 14 and 18, so an adhesive is not needed to secure them together, so the hydrophobic agent can be included in the intermediate layer 14 without adversely affecting the integrity of the attachment between the two layers 14 and 18. And second, this arrangement enables ink or paint to be applied onto the water-resistant layer 18 (for labeling, instructions, and/or other markings) and enables adhesive tapes and other sealants to be applied to edge portions of the panels (to cover the seams between adjacent panels to keep water out of the building envelope), so the hydrophobic agent can be included in the intermediate layer 14 without adversely affecting the ink, paint, adhesive, sealant, etc., on the outward-facing surface of the panel 10. In addition, the open-backed fiberglass water-resistant layer 18 would not function as well without the hydrophobic additives in the intermediate layer 14, that is, these two layers 14 and 18 work better together at water repelling than either one alone. Furthermore, the hydrophobic additives in the intermediate layer 14 would not perform properly without the open-backed fiberglass water-resistant layer 18. Without the fiber strands 28 embedded into the intermediate layer 14, an adhesive would be needed, which would then prevent the addition of hydrophobic agents within the panel due to their interference with the adhesion of layer 14. This applies primarily to water-based adhesive, which are more desirable from a handling and environmental standpoint. An important factor in allowing the inclusion of the hydrophobic additives in the intermediate layer 18, without the possible negative impact associated with them, relies on the inclusion of the divider layer 16.

In other example embodiments, the panel includes the water-resistant layer secured to an adjacent structural layer of a different design and construction. As such, the water-resistant layer includes the fiber-based carrier layer with the weather barrier on its outward-facing surface and with the uncoated/open backer (loose fiber strands extending and embedded into the adjacent layer) on its inward-facing surface. The adjacent structural layer, however, can be made of different materials and/or designs (e.g., a single curable structural layer, two layers with the adjacent/intermediate layer of a non-cementitious curable material, etc.), as may be desired for a particular application.

Figure 2:
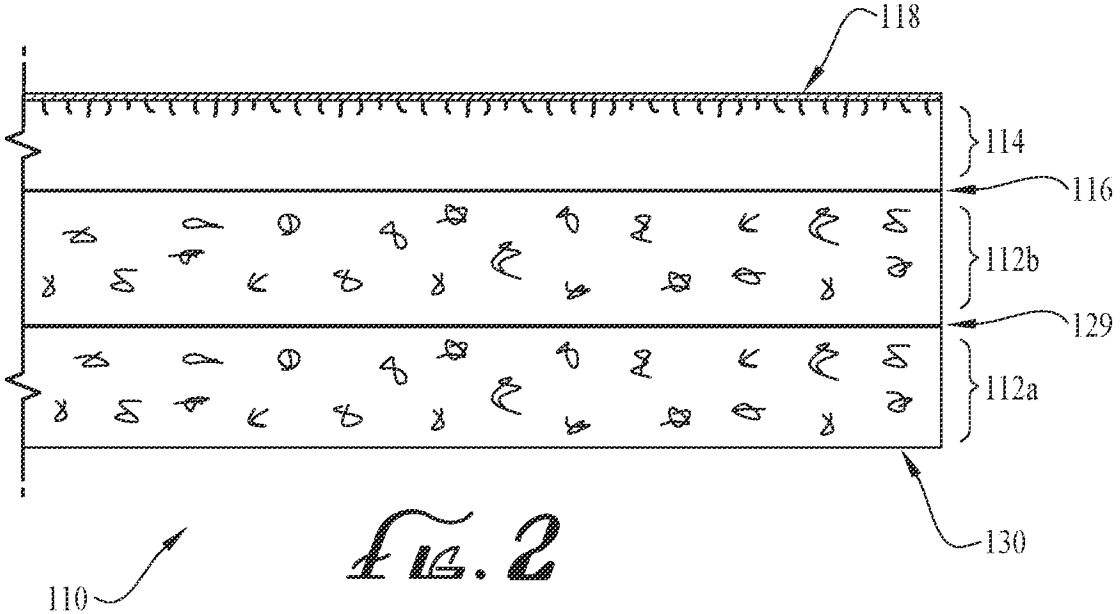
FIG. 2 is a side cross-sectional view of a portion of a structural fire- and water-resistant panel according to a second example embodiment of the invention.

Turning now to FIG. 2, there is shown a structural fire-resistant water-resistant panel 110 according to a second example embodiment. The panel 110 can be substantially similar to the panel 10 described herein, with exceptions as noted.

In particular, whereas the panel 10 includes one core layer 12, the panel 110 of this embodiment includes two stacked core layers 112*a* and 112*b* (collectively, the core layers 112) with a reinforcement layer 129 positioned between them. In other embodiments, the panel includes three (or more) core layers and two (or more) reinforcement layers, with a respective reinforcement layer between every two adjacently positioned core layers. The reinforcement layer 129 can be provided by a fiberglass sheet or scrim, or another reinforcing material known in the art such as sheets of woven or non-woven fiberglass, polyester, nylon, or another synthetic or natural fiber.

In addition, the bottom-most core layer 112*a* (farthest from the intermediate layer 114) has a backing layer 130 on its bottom surface. For example, the backing layer 130 can be a non-woven fabric cloth. The backing layer 130 can be included on panels of other embodiments.

For clarity, the panel 110 also includes the divider layer 116 between the uppermost core layer 112*b* and intermediate layer 114, and the water-resistant layer 118 on the intermediate layer 114 opposite the core layers 112.

Figure 3:
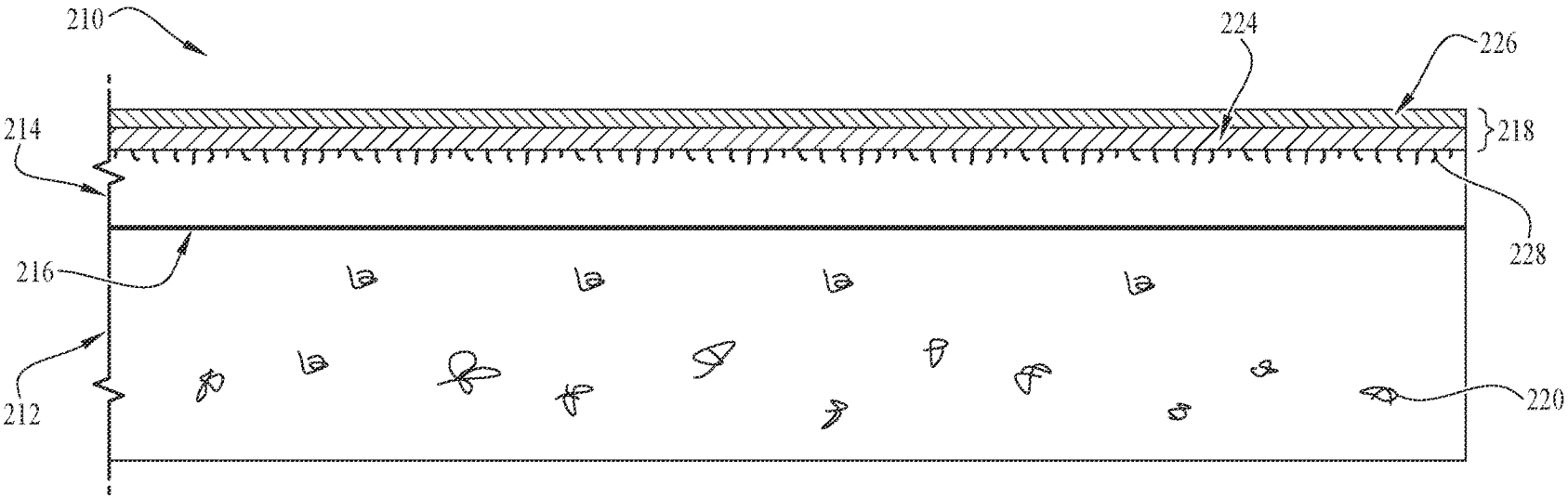
FIG. 3 is a side cross-sectional view of a portion of a structural fire- and water-resistant panel according to a third example embodiment of the invention.

Turning now to FIG. 3, there is shown a structural fire-resistant water-resistant panel 210 according to a third example embodiment. The panel 210 can be substantially similar to the panel 10 described herein, with exceptions as noted.

In particular, the panel 210 includes a core layer 212 (with aggregates 220), an intermediate layer 214 (without aggregates 220), a divider layer 216 between the core layer 212 and the intermediate layer 214, and a water-resistant layer 218 on the intermediate layer 214 opposite the core layer 212. The core layer 212, the aggregates 220, the intermediate layer 214, and the divider layer 216 can be the same or substantially similar to the same components in the panel 10 described herein, so for brevity details of these components are not repeated.

In this embodiment, however, the water-resistant layer 218 has a different design. In particular, whereas the water-resistant layer 18 of the panel 10 of the first embodiment includes a non-woven fiber-based carrier layer 24 with a hydrophobic treatment weather barrier 26, the water-resistant layer 218 of the panel 210 of this embodiment includes a non-woven fiber-based carrier layer 224 with a different weather barrier 226 secured to it. The fiber-based carrier layer 224 can be of the same type as in the panel 10, such as a sheet of natural or synthetic fiber material (e.g., fiberglass, mineral fibers, polymer fibers such as polyester or polypropylene, or a mixture thereof) with the secured surface abutting the intermediate layer 214 being uncoated so it has an open backing with a plurality of loose fiber strands 228 extending from it and into the intermediate layer 214 to help secure the water-resistant layer 218 to the intermediate layer 214 during curing of the intermediate layer 214.

The weather barrier 226 can be secured to the non-woven carrier layer 224 for example by these two layers being laminated or extruded together (e.g., extruded onto or co-extruded). The weather barrier 226 is secured to the outward-facing surface of the fiber-based carrier layer 224 (opposite the intermediate layer 214). The weather barrier 226 meets the water-resistant properties defined by test methods such ASTM E2556M, ASTM D5795, and/or ASTM E331. In this way, the water-resistant layer 218 is substantially impermeable to liquid (bulk) water ingress into the intermediate layer 214 (to prevent liquid water penetration into the panel 210 and possibly into the building, or at least to minimize it to a negligible extent) but is permeable to water vapor egress from the intermediate layer 214 to allow drying (to provide breathability to allow the panel 210 to dry if excess moisture builds up within the panel 210).

In typical embodiments, the weather barrier 226 of this embodiment is a sheet of thermoplastic film such as thermoplastic polyurethane (TPU), polycarbonate (PC), PETG/co-polyester, acrylic (PMMA), rigid and/or flexible PVC, and/or a polyolefin such as polyethylene, polypropylene, and mixtures thereof. In some embodiments, the weather barrier 226 can be thermoplastic film applied to the non-woven carrier layer 224 as a coating (e.g., by using a curtain coater, spray process, or any other conventional application technique) that cures or dries to form the weather barrier 226 as a sheet on the non-woven carrier layer 224. Alternatively, the weather barrier 226 can be a resin saturated paper overlay suitable for lamination onto the fiber-based carrier layer 224.

Figure 4:
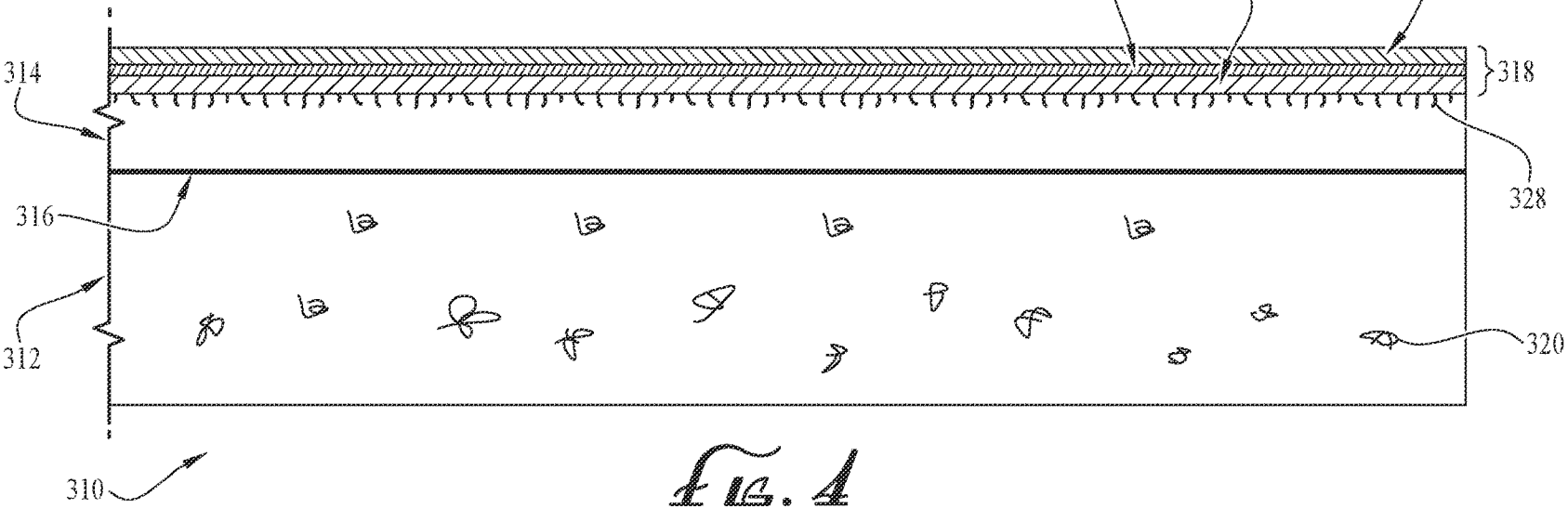
FIG. 4 is a side cross-sectional view of a portion of a structural fire- and water-resistant panel according to a fourth example embodiment of the invention.

Turning now to FIG. 4, there is shown a structural fire-resistant water-resistant panel 310 according to a fourth example embodiment. The panel 310 can be substantially similar to the panel 210 described herein, with exceptions as noted.

In particular, the panel 310 includes a core layer 312 (with aggregates 320), an intermediate layer 314 (without aggregates 320), a divider layer 316 between the core layer 312 and the intermediate layer 314, and a water-resistant layer 318 on the intermediate layer 314 opposite the core layer 312. Also, the water-resistant layer 318 includes a non-woven fiber-based carrier layer 324 (with loose fiber strands 328) with a weather barrier 326 secured to it. These components can be the same or substantially similar to the same components in the panel 210 described herein, so for brevity details of these components are not repeated.

In this embodiment, however, the fiber-based carrier layer 324 and the weather barrier 326 are secured together differently. In particular, the fiber-based carrier layer 324 and the weather barrier 326 are secured together by an adhesive layer 325, for example, the adhesive can be a contact adhesive, neoprene rubber adhesive, acrylic or acrylate, pressure-sensitive adhesive, hot melt, polyurethane resin or dispersion, polyvinyl acetate or modified polyvinyl acetate, polyurethane or polyurethane dispersion, epoxy, polyamide, another conventional adhesive suitable for adhering/bonding these layers together, and/or a mixture of these. In typical embodiments, the weather barrier 326 is a thermoplastic film such as thermoplastic polyurethane (TPU), polycarbonate (PC), PETG/co-polyester, acrylic (PMMA), rigid and/or flexible PVC, and/or a polyolefin such as polyethylene, polypropylene, and mixtures thereof. Alternatively, the weather barrier 326 can be a resin saturated paper overlay suitable for bonding to the fiber-based carrier layer 324.

This embodiment can be beneficial in instances when lamination or extrusion between the non-woven fiber-based carrier layer 324 and the weather barrier 326 are problematic. This can be the case for example when the melt point of the weather barrier 326 is very similar to the non-woven fiber-based carrier layer 324.

Figure 5:
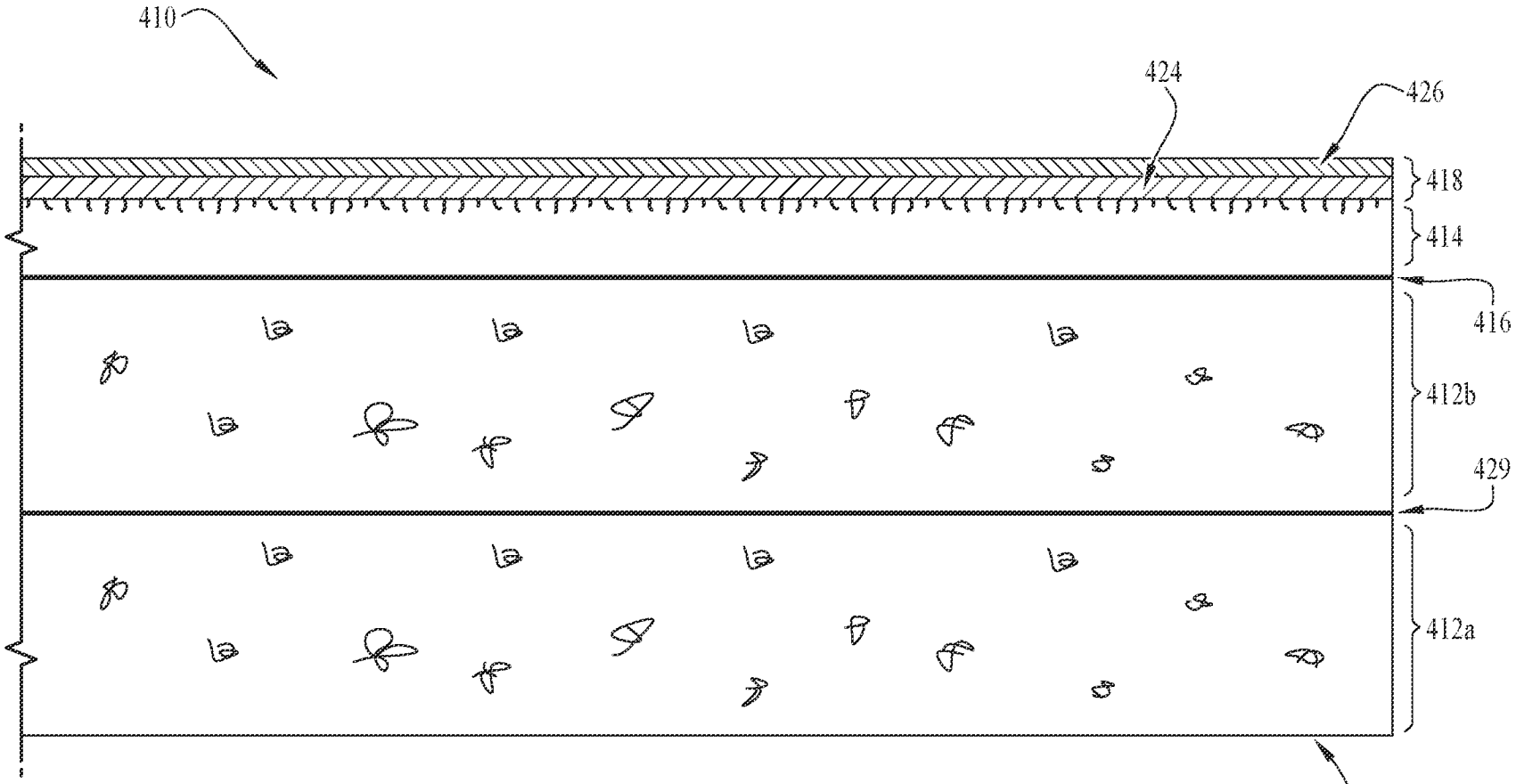
FIG. 5 is a side cross-sectional view of a portion of a structural fire- and water-resistant panel according to a fifth example embodiment of the invention.

Turning now to FIG. 5, there is shown a structural fire-resistant water-resistant panel 410 according to a fifth example embodiment. The panel 410 can be substantially similar to the other panels described herein, with exceptions as noted.

In particular, the panel 410 combines the multi-core layer arrangement of the panel 110 with the water-resistant layer of the panel 210. As such, the panel 410 includes core layers 412*a* and 412*b* (with aggregates 420 and a reinforcement layer 429), an intermediate layer 414 (without aggregates 420), a divider layer 416 between the uppermost core layer 412*b* and the intermediate layer 414, and a water-resistant layer 418 on the intermediate layer 414 opposite the uppermost core layer 412*b*. These components can be the same or substantially similar to the same components in the panel 110 described herein, so for brevity details of these components are not repeated. Except that the water-resistant layer 418 includes a non-woven fiber-based carrier layer 424 (with loose fiber strands 428) with a weather barrier 426 secured to it (for example by lamination or co-extrusion) as in the panel 210, so for brevity details of these components are not repeated.

Figure 6:
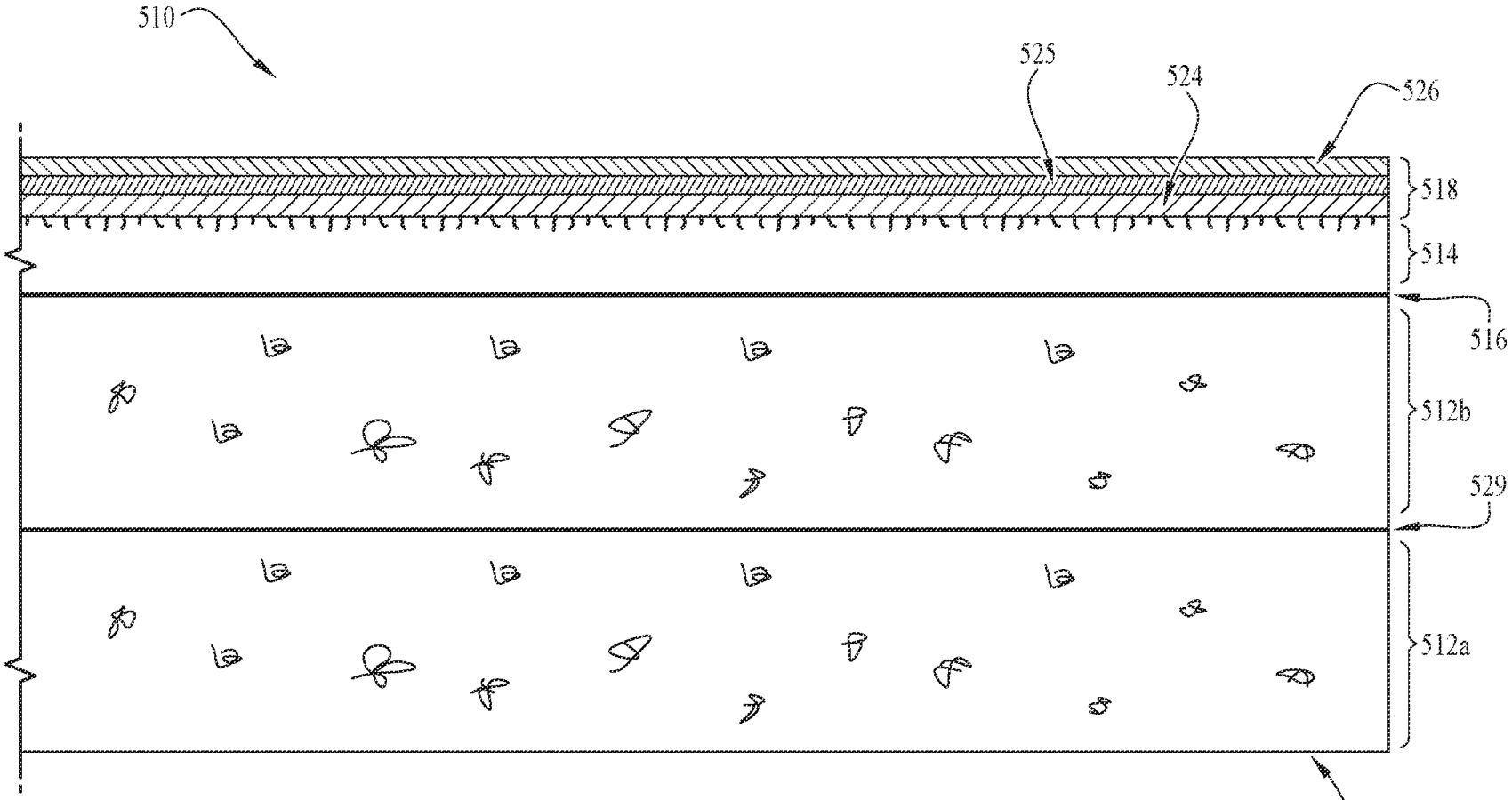
FIG. 6 is a cross-sectional view of a portion of a structural fire- and water-resistant panel according to a sixth example embodiment of the invention.

Turning now to FIG. 6, there is shown a structural fire-resistant water-resistant panel 510 according to a sixth example embodiment. The panel 510 can be substantially similar to the other panels described herein, with exceptions as noted.

In particular, the panel 510 combines the multi-core layer arrangement of the panel 110 with the water-resistant layer of the panel 310. As such, the panel 410 includes core layers 512*a* and 512*b* (with aggregates 520 and a reinforcement layer 529), an intermediate layer 514 (without aggregates 520), a divider layer 516 between the uppermost core layer 512*b* and the intermediate layer 514, and a water-resistant layer 518 on the intermediate layer 514 opposite the uppermost core layer 512*b*. These components can be the same or substantially similar to the same components in the panel 110 described herein, so for brevity details of these components are not repeated. Except that the water-resistant layer 518 includes a non-woven fiber-based carrier layer 524 (with loose fiber strands 528) with a weather barrier 526 secured to it by an adhesive layer 525 as in the panel 310, so for brevity details of these components are not repeated.

With reference to FIGS. 7-10, there will now be described a method 600 of manufacturing structural fire-resistant water-resistant panels according to another example embodiment. The method 600 can be used to manufacture any of the panels 10, 110, 210, 310, 410, and 510 described herein or other related structural fire-resistant water-resistant panels.

Figure 7:
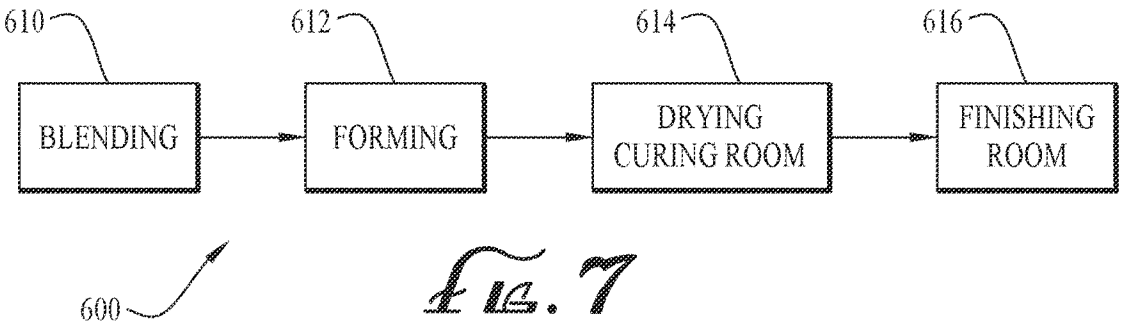
FIG. 7 is a process flow diagram of a method of manufacturing a structural fire- and water-resistant panel according to another example embodiment of the invention.

FIG. 7 shows the overall manufacturing process 600, including the steps of blending 610, forming 612, curing 614, and finishing 616. It will be understood that the specifics of each of these steps are representative for illustration purposes only and thus are not limiting of the invention.

Figure 8:
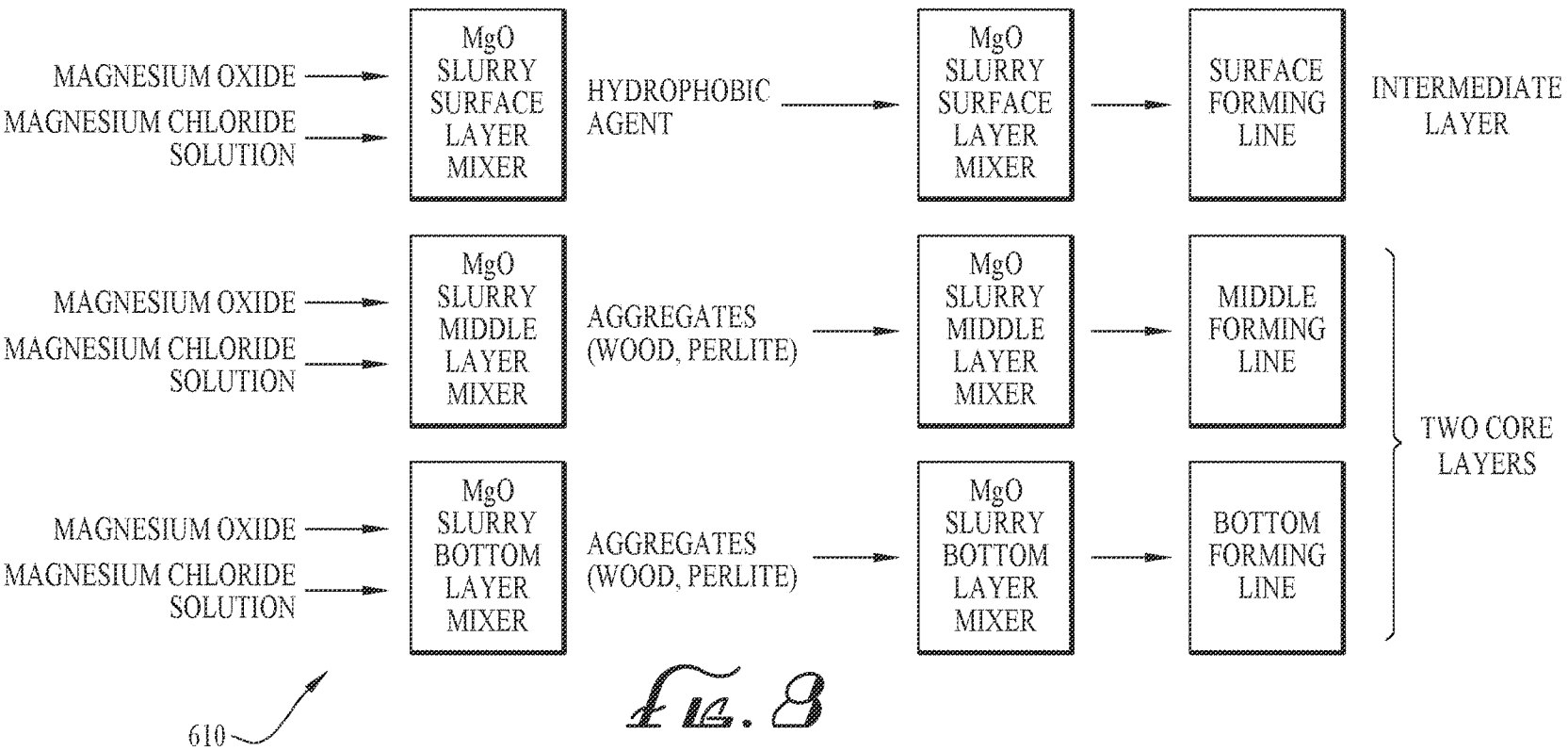
FIG. 8 is a process diagram of a material blending step of the manufacturing method of FIG. 7.
Figure 9:
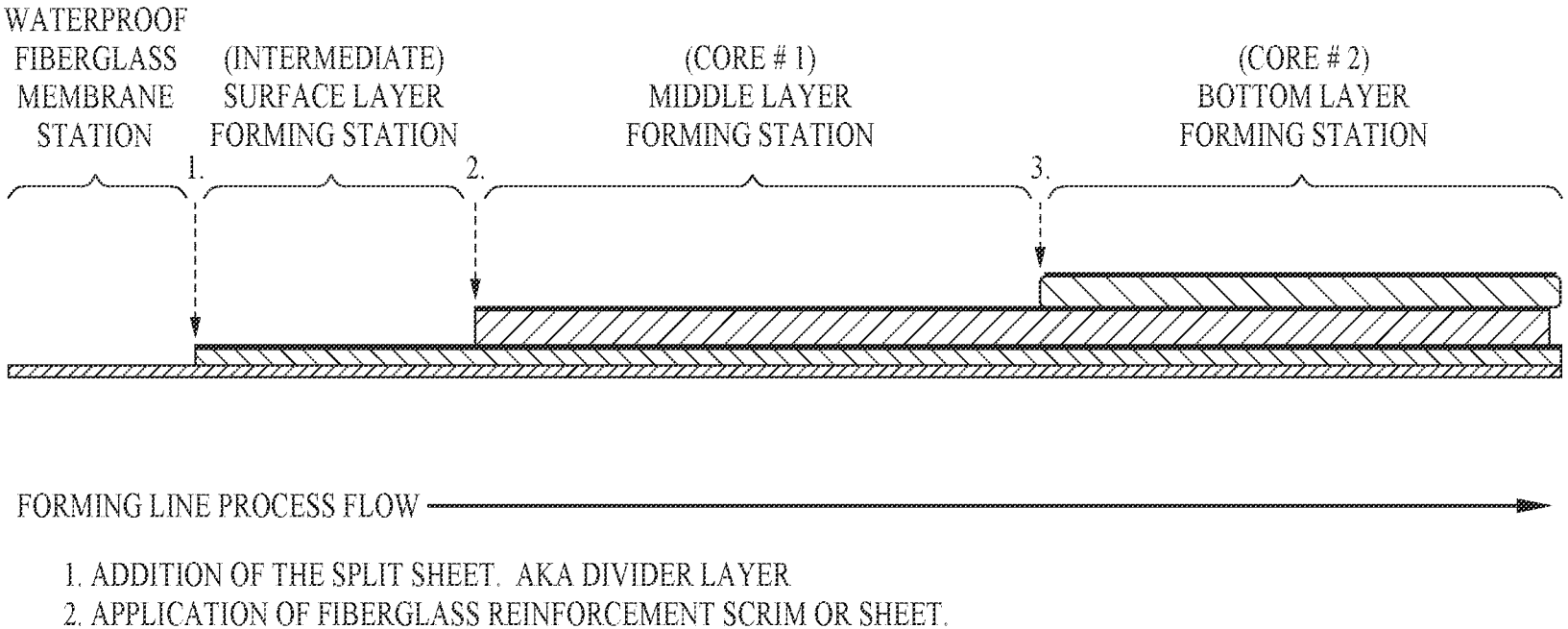
FIG. 9 is a process diagram of a panel forming step of the manufacturing method of FIG. 7.

In an example of blending step 610 shown in FIG. 8, a first magnesium oxide slurry for forming the intermediate layer is prepared and a second magnesium oxide slurry for forming the one or more core layers is prepared. For each, magnesium oxide and magnesium chloride are introduced into a mixing tank (or other mixing vessel) and agitated (e.g., about two and four minutes) to allow for proper hydration of the magnesium oxide.

For the intermediate-layer magnesium oxide slurry, this is followed by the introduction of at least one hydrophobic agent and optionally sulfuric acid, if desired (sulfuric acid being often used to slow down the curing process in the summertime or otherwise heightened ambient temperatures). The hydrophobic agent can of the type described above with reference to the intermediate layer 14 of the panel 10. Typical loadings (the proportion of the hydrophobic agent to the total composition of the slurry) to ensure proper water repellency are between about 0.02 percent to about 5.0 percent by weight of the total composition of the slurry. In some embodiments, concentrated (e.g., 85 percent) sulfuric acid (an additive that can be used to slow down the reaction of MgO—MgCl) can be introduced (e.g., last) at a level for example between about 0.01 percent to about 0.20 percent by weight of the total composition. The additives are then mixed into the blended magnesium oxide and magnesium chloride (e.g., about an additional one to three minutes) to ensure proper dispersion. Once the intermediate layer slurry is completed, it is set aside (e.g., in a day-use tank) prior to use on the forming line.

For the core-layer magnesium oxide slurry, this is followed by the introduction of at least one aggregate, for example as described above with reference to the core layer 12 of the panel 10. Once the core layer slurry is completed, it is set aside (e.g., in a day-use tank) prior to use on the forming line.

In an example of forming step 612 shown in FIG. 7, the panel layers are placed together. A water-resistant layer is formed, for example, by coating a fiberglass sheet on one side (to be the outward-facing surface of the panel) with a water-repellent coating (e.g., of the type described above with reference to the water-resistant layer 18), leaving the opposite side (to be placed against the intermediate layer) as an open backer side consisting of loose fibers. The water-resistant layer is fed on the panel forming line with its coated side facing down. The intermediate-layer magnesium oxide slurry from the blending step 610 is delivered (e.g., pumped) onto the backer side of the water-resistant layer to achieve, for example, a weight between about 3 percent and about 20 percent of the total magnesium oxide slurry weight requirement. An optional reinforcing layer (e.g., a reinforcing fiberglass scrim or sheet) can be added to the intermediate layer to improve the overall strength of the layer.

Once the slurry application of the intermediate layer is completed, a divider layer is applied on top of the intermediate layer. The divider layer can of the type described above with reference to the divider layer 16 of the panel 10.

On top of the divider layer, a core layer of a second magnesium oxide slurry is added to provide the bulk of the structural capacity of the panel. The core-layer magnesium oxide slurry typically includes magnesium oxide, magnesium chloride, and aggregates, for example as described above with reference to the core layer 12 of the panel 10.

Depending on the panel thickness and mechanical properties desired, reinforcing layers (e.g., a reinforcing fiberglass scrims or sheets) can be inserted throughout the core layer to increase strength by providing increased load distribution. For example, embodiments with multiple core layers (for example, the panel 110) can be made by applying a portion of the core-layer magnesium oxide slurry, adding a reinforcing layer, and then applying another portion of the core-layer magnesium oxide slurry, so that the reinforcing layer is interposed between the portions of the core-layer magnesium oxide slurry.

An optional backing layer (e.g., a non-woven fabric cloth) to form the back of the panel. The panel layers are now all in place and in a continuous sheet. The continuous sheet is then cut or otherwise separated (e.g., by an automated circular saw) into individual wet panels (e.g., 4 ft by 8 ft).

In an example of the curing step 612, the individual wet panels are loaded into a drying\curing station, for example by being placed on individual mold plates on a rack that is delivered to a temperature-controlled drying\curing room. The individual wet panels are then dried/cured, for example at a curing temperature of about 25 degrees C. to about 50 degrees C., for a time period of about 72 hours, to form individual dry panels.

Figure 10:
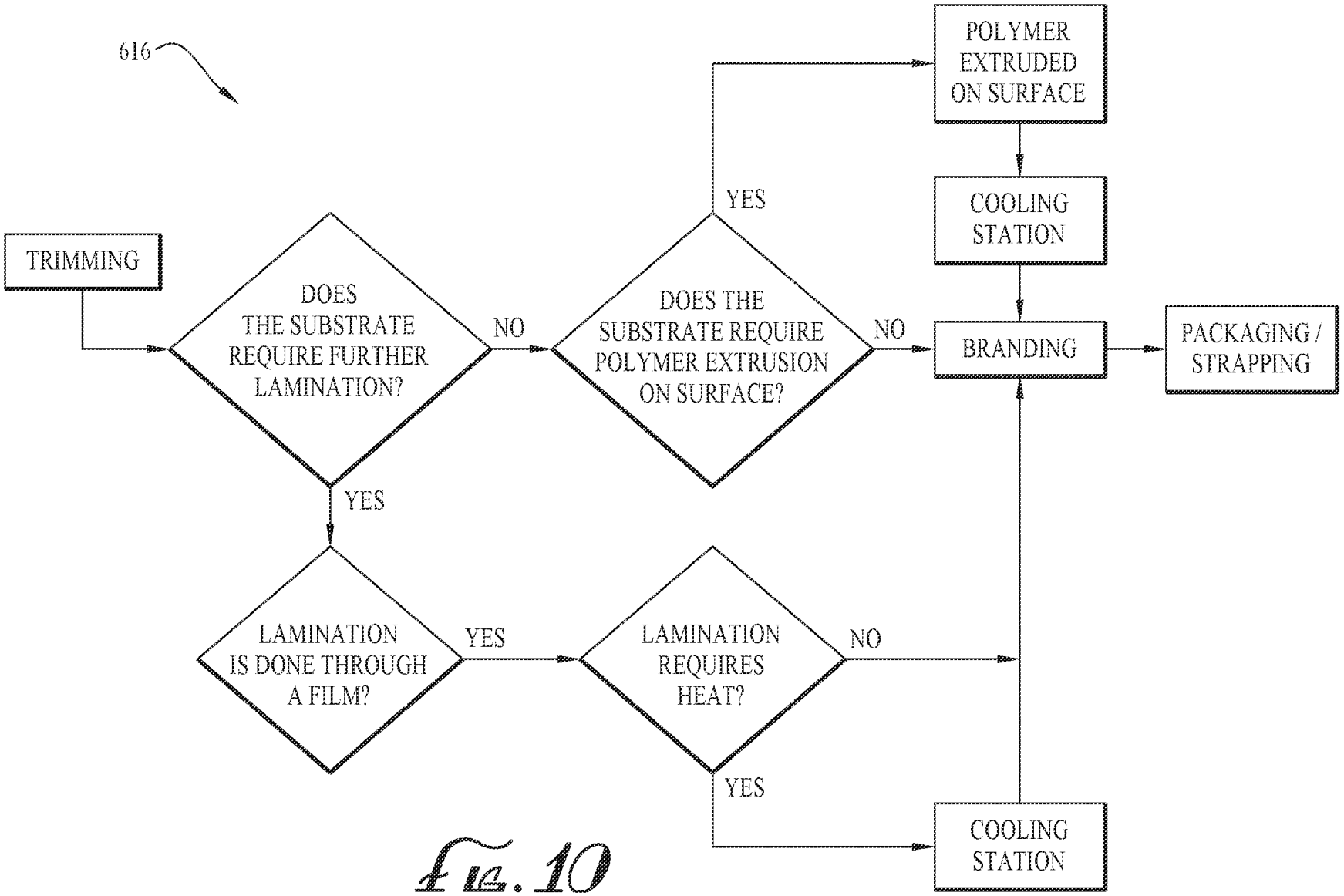
FIG. 10 is a process diagram of a finishing line step of the manufacturing method of FIG. 7.

Finally, FIG. 10 shows examples of the finishing step 614 for the various embodiments described herein to apply the water-resistive barrier 18, 118, 218, 318, 418, and 518 of FIGS. 1, 2, 3, 4, 5, and 6. In this finishing step 614, the individual cured panels are then transferred to a finishing station, where panels are trimmed, laminated (if necessary), marked, stacked, and strapped into units.

Laboratory testing was to demonstrate the advantages of the panel 10 of FIG. 1 described above. In this testing, several different samples of core layers 12 and intermediate layers 14 were prepared in a laboratory to verify the water absorption of the layers. The core and intermediate layer slurry formulations, and the test result data, of the samples are detailed in Table A.

TABLE A

Water absorption and density results

| MgO layer | Initial weight | Final weight | % Water absorption | Sample density (lbs/ft$^3$) |
|---|---|---|---|---|
| Core | 45.18 | 54.08 | 19.7 | 59.8 |
| Core | 60.87 | 72.62 | 19.3 | 80.5 |
| Core | 50.36 | 59.15 | 17.45 | 66.6 |
| Intermediate | 70.1 | 75.7 | 7.99 | 92.7 |
| Intermediate | 70.1 | 75.6 | 7.84 | 92.7 |

The samples were prepared by pouring the different slurry formulations into silicone molds. The samples were then air dried overnight (22 degrees C., 50 percent RH), demolded, and cured in an oven at 45 degrees C. over a three-day period. The samples were weighed after the completion of the curing period and soaked in distilled water at 22 degrees C. for 24 hrs. The samples were then taken out of the water, patted dry, and weighted again to verify the weight gain over time.

Figure 11:
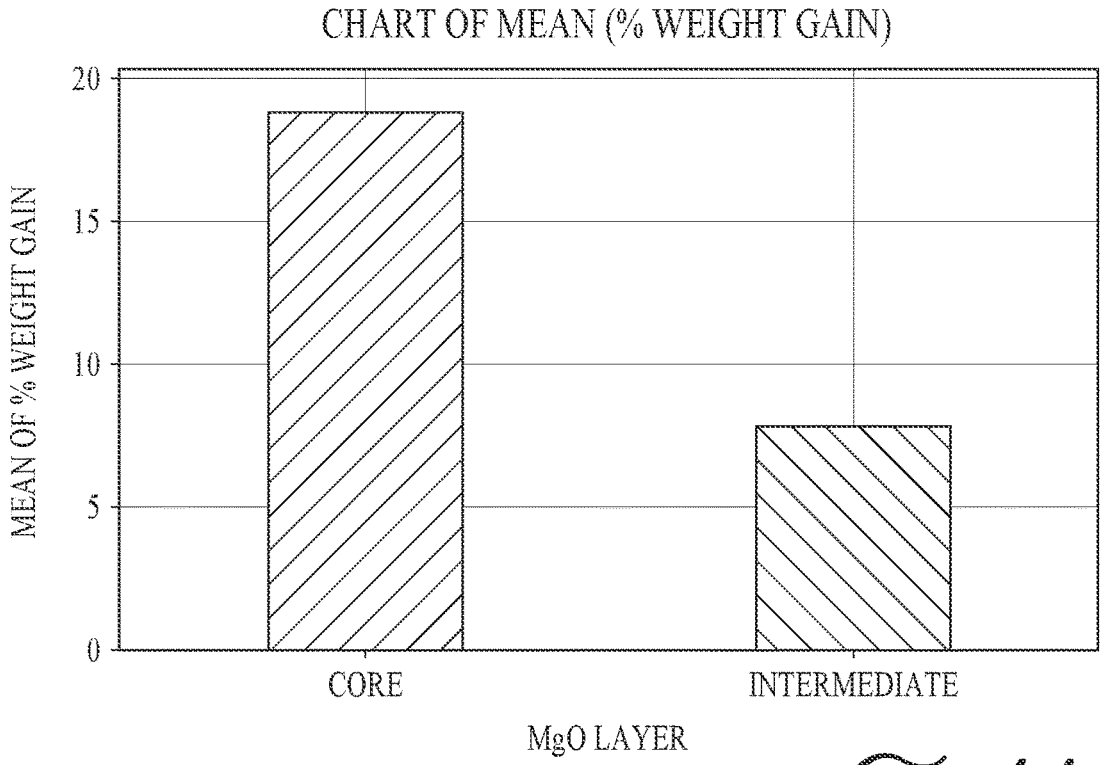
FIG. 11 is a bar graph showing water absorption for different core and intermediate layer formulations.

Test results are shown in FIG. 11. As shown, the intermediate layer samples on average are much more resistant in absorbing water than the core layer samples on average. The wood fiber aggregates in the core layer samples can lead to significant water absorption by the core layer samples, but the inclusion of the divider and intermediate layers in the manufactured panels prevents this and thereby also maintains the lower density of the core layer (4 ft by 8 ft panels are bulky, and any added weight can make it difficult for workers to carry them safely), as shown in Table A.

Figure 12:
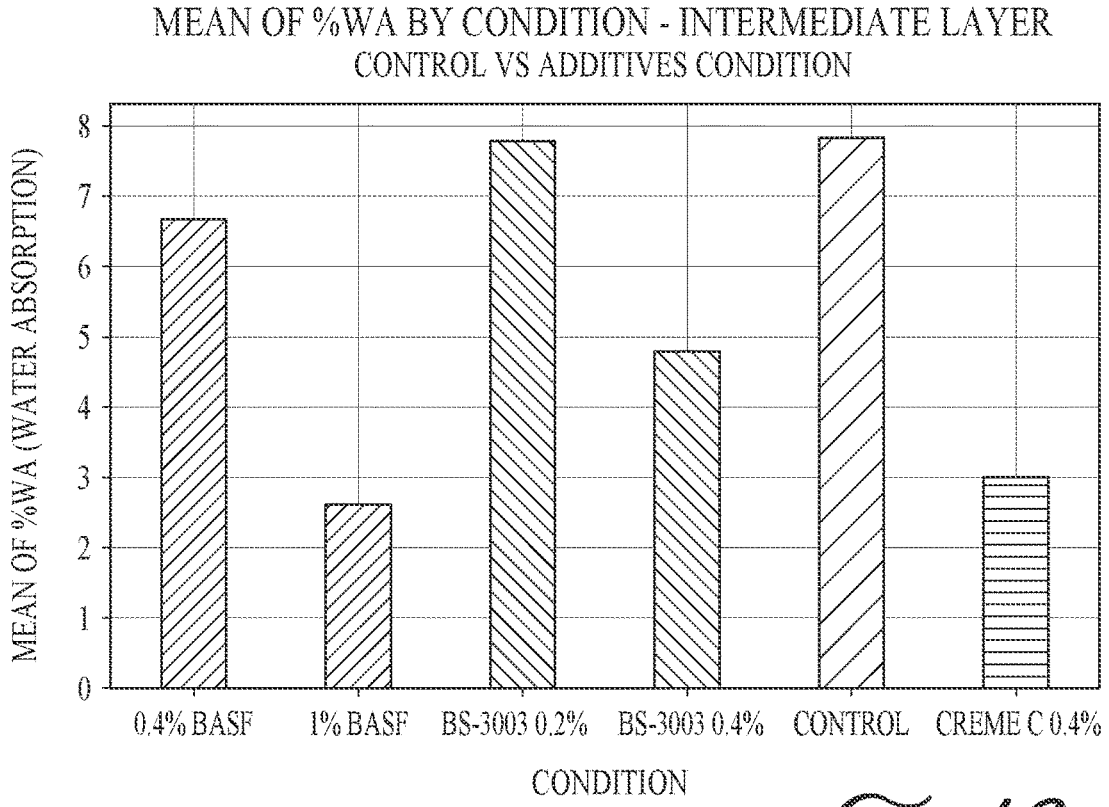
FIG. 12 is a bar graph showing water absorption for different intermediate layer formulations including different hydrophobic additives.
Figure 13:
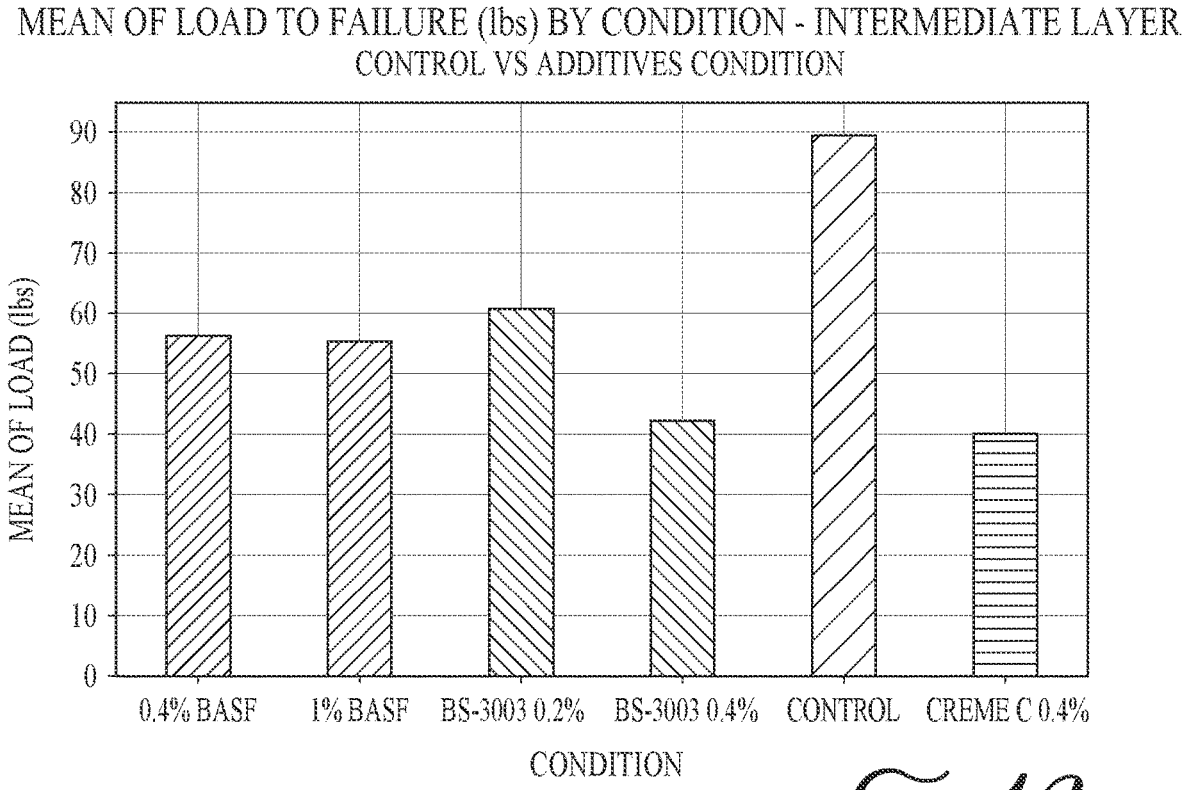
FIG. 13 is a bar graph showing loading at failure when subjected to bending loads for the intermediate layer formulations including the hydrophobic additives of FIG. 12.

FIG. 12 shows water absorption for different intermediate layer sample formulations including different hydrophobic additives, with the addition of the hydrophobic agents to the intermediate layer samples reducing water absorption significantly. However, as shown in FIG. 13, the addition of the hydrophobic additives can lead to reduction in mechanical properties when the intermediate layer samples are subjected to bending.

Figure 14:
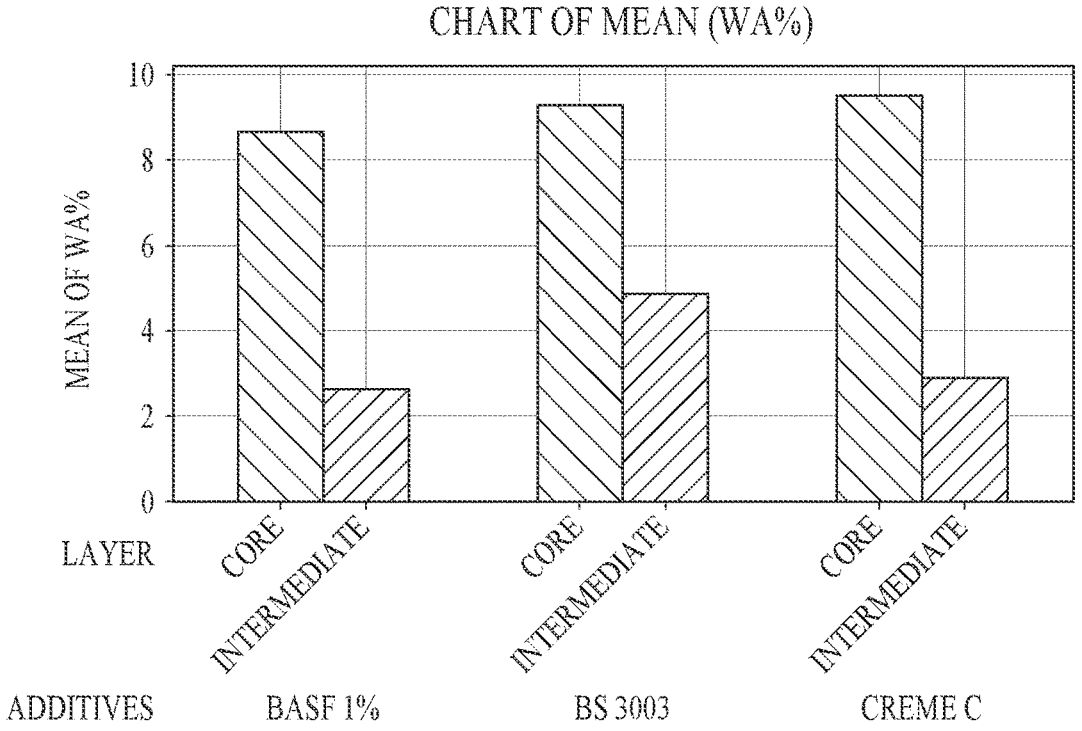
FIG. 14 is a bar graph showing water absorption for different core layer formulations and different intermediate layer formulations including different hydrophobic additives.

Finally, sample panels 10 of FIG. 1 (with the divider layer and the intermediate layer hydrophobic additives) were subjected to water-resistance testing using the Cobb test method (which consists of adding 97 g of water within the ring and weighing water uptake after 24 hours). The Cobb test results showed minimal water absorption, as shown in Table B and FIG. 14.

TABLE B

Cobb Test results (for the panel 10 of FIG. 1)

| Treatment | Water uptake (g) | Cobb Number |
|---|---|---|
| BASF 1% | 0.62 | 4.9 |
| BASF 1% | 0.74 | 5.9 |
| Crème C 0.4% | 0.62 | 4.9 |
| Crème C 0.4% | 0.7 | 5.6 |
| BS 1042 0.4% | 0.46 | 3.7 |
| BS 1042 0.4% | 0.56 | 4.5 |

These Cobb numbers are well within the range of other panel systems which provide Type 1 or Type 2 water-resistive barriers available on the market such as those found on ZIP SYSTEM panels.

Similarly, sample panels 210 of FIG. 3 (with the divider layer and the intermediate layer hydrophobic additives) were subjected to water-resistance testing using the Cobb test method. The Cobb test results showed minimal water absorption, as shown in Table C.

TABLE C

Cobb Test Results (for the panel 210 of FIG. 3)

| Membrane | Water Uptake (g) | Cobb number |
|---|---|---|
| Polyester + TPU film extruded | 0.64 | 5.1 |
| Polypropelyne + water resistant layer | 0.97 | 7.7 |
| Polyester + TPU film laminated | 0.2 | 2.0 |

These Cobb numbers are well within the range of other panel systems which provide Type 1 or Type 2 water-resistive barriers available on the market such as those found on ZIP SYSTEM panels.

It is to be understood that this invention is not limited to the specific devices, methods, conditions, or parameters described and/or shown herein, and that the terminology used herein is for the purpose of describing particular embodiments by way of example only. Thus, the terminology is intended to be broadly construed and is not intended to be unnecessarily limiting of the claimed invention. For example, as used in the specification including the appended claims, the singular forms "a," "an," and "one" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

While the invention has been shown and described in exemplary forms, it will be apparent to those skilled in the art that many modifications, additions, and deletions can be made therein without departing from the spirit and scope of the invention as defined by the following claims.

What is claimed is:

1. A structural, fire-resistant, water-resistant panel, comprising:

a core layer having structural-strength and fire-resistance properties, the core layer including a cementitious material that provides the structural-strength and fire resistance properties and an aggregate material that supplements the structural-strength properties;

an intermediate layer having structural-strength, fire-resistance, and water-repellency properties, the intermediate layer including a cementitious material that provides the structural-strength and fire-resistance properties and a hydrophobic additive that provides the water-repellency properties;

a divider layer positioned between the core and intermediate layers to form a physical barrier that prevents cross-migration of the aggregate material and the hydrophobic additive between the core and intermediate layers, wherein the divider layer is made of a sheet of non-woven or woven material including a polymer and having a density that provides a physical separation that prevents passage through it of the aggregate material from the core layer to the intermediate layer to prevent the aggregate material from lessening the water-repellency properties of the intermediate layer and that prevents passage through it of the hydrophobic material from the intermediate layer to the core layer to prevent the hydrophobic additive from lessening the structural-strength properties of the core layer; and a water-resistant layer on the intermediate layer and positioned opposite the core layer, the water-resistant layer having water-resistance properties.

2. The panel of claim 1, wherein the cementitious material of the core layer, the cementitious material of the intermediate layer, or both includes magnesium oxide selected for providing structural strength and fire-resistance properties.

3. The panel of claim 1, wherein the aggregate material of the core layer includes a biomaterial, perlite, glass fibers, expanded clay, or a combination thereof selected for having added structural strength, lower density and weight, and fastener-holding properties to the cementitious material of the core layer.

4. The panel of claim 1, wherein the hydrophobic additive of the intermediate layer includes silicone, siloxane, another inorganic or polymer-based material, and/or a combination thereof selected for reducing water ingress and absorption into the cementitious material of the intermediate layer.

5. The panel of claim 1, wherein the polymer of the divider layer is polypropylene, polyethylene, polyester, polystyrene, rayon, other natural and/or synthetic polymers, and/or a combination thereof selected to prevent cross-migration of the aggregate material and the hydrophobic additive between the core and intermediate layers.

6. The panel of claim 1, wherein the core layer includes multiple stacked core layers, including a first core layer and a second core layer, with a reinforcement layer between the first and second core layers, and with the divider layer between the second core layer and the intermediate layer.

7. The panel of claim 1, wherein the water-resistant layer includes a fiber-based carrier layer with an outward-facing surface and an opposite inward-facing surface, wherein the inner-facing surface of the fiber-based carrier layer is uncoated to form an open backer with loose fiber strands extending therefrom, and wherein the loose fiber strands are embedded into the intermediate layer to secure the water-resistant layer to the intermediate layer.

8. The panel of claim 7, wherein the water-resistant layer further includes a weather barrier on the outward-facing surface of the fiber-based carrier layer, wherein the weather barrier is impermeable to liquid (bulk) water ingress into the intermediate layer but is permeable to water vapor egress from the intermediate layer.

9. A method of manufacturing the panel of claim 1, comprising:

laying down the water-resistant layer with the outward-facing surface facing downward;

laying down a slurry of the cementitious material and the hydrophobic additive onto the water-resistant layer to form the intermediate layer;

laying down the divider layer onto the slurry of the cementitious material and hydrophobic additive;

laying down a slurry of the cementitious material and the aggregate material onto the divider layer to form the core layer; and curing the layers to form the panel.

10. The manufacturing method of claim 9, wherein:

the water-resistant layer includes a fiber-based carrier layer with a weather barrier secured to the outward-facing surface thereof and includes an opposite inner-facing surface uncoated to form an open backer with loose fiber strands extending therefrom;

the step of laying down the water-resistant layer includes laying down the water-resistant layer with the open backer facing upward; and the step of laying down the slurry of the cementitious material and hydrophobic additive includes laying down the slurry of the cementitious material and hydrophobic additive onto the open backer of the fiber-based carrier layer to form the intermediate layer so that, upon curing of the panel, the loose fiber strands are embedded into the intermediate layer to secure the water-resistant layer to the intermediate layer.

11. A structural, fire-resistant, water-resistant panel, comprising:

at least one structural layer having structural-strength, fire-resistance, water-resistance properties, the structural layer including a cementitious material that provides the structural-strength and fire-resistance properties and a hydrophobic agent that provides the water-resistance properties;

a water-resistant layer on the structural layer having water-resistance properties, wherein the water-resistant layer includes a fiber-based carrier layer with an outward-facing surface and an opposite inward-facing surface, wherein the inward-facing surface of the fiber-based carrier layer is uncoated to form an open backer with loose fiber strands extending therefrom, and wherein the loose fiber strands are embedded into the structural layer during curing of the cementitious material to secure the water-resistant layer to the structural layer without using an adhesive; and a weather barrier including a hydrophobic treatment on the outward-facing surface of the fiber-based carrier layer.

12. The panel of claim 11, wherein the hydrophobic treatment is phenolic resin, melamine formaldehyde resin, acrylic or modified acrylic resin, or polyurethane dispersion selected for providing water-resistance properties.

13. The panel of claim 11, wherein the weather barrier is laminated or extruded with, or adhered/bonded onto, the outward-facing surface of the fiber-based carrier layer.

14. The panel of claim 13, wherein the weather barrier is a sheet of thermoplastic polyurethane (TPU), polycarbonate (PC), PETG/co-polyester, acrylic (PMMA), rigid and/or flexible PVC, polyethylene, polypropylene, another polyolefin, another thermoplastic film, or a combination thereof, selected for having water-resistance properties.

15. A structural, fire-resistant, water-resistant panel, comprising:

a core layer having structural-strength and fire-resistance properties, the core layer including a cementitious material and an aggregate material, the cementitious material including magnesium oxide, and the aggregate material including biomaterial, perlite, glass fibers, expanded clay, or a combination thereof, wherein the core layer is structural;

an intermediate layer having structural-strength, fire-resistance, and water-repellency properties, the intermediate layer including a cementitious material and a hydrophobic additive, the cementitious material including magnesium oxide, and the hydrophobic additive including silicone, siloxane, or another inorganic or polymer-based material;

a divider layer positioned between the core and intermediate layers to form a physical barrier that prevents cross-migration of the aggregate material and the hydrophobic additive between the between the core and intermediate layers, wherein the divider layer is made of a sheet of non-woven or woven material including a polymer and having a density that prevents passage through it of the aggregate material from the core layer to the intermediate layer to prevent the aggregate material from lessening the water-repellency properties of the intermediate layer and that prevents passage through it of the hydrophobic material from the intermediate layer to the core layer to prevent the hydrophobic additive from lessening the structural-strength properties of the core layer; and a water-resistant layer providing water-resistance properties and positioned on the intermediate layer opposite the core layer, the water-resistant layer including a fiber-based carrier layer with an outward-facing surface and an opposite inward-facing surface, and the inward-facing surface of the fiber-based carrier layer being uncoated to form an open backer with loose fiber strands extending therefrom, wherein the loose fiber strands are embedded into the intermediate layer during curing of the cementitious material to secure the water-resistant layer to the intermediate layer without using an adhesive, wherein the loose fiber strands are secured to the intermediate layer by the cured cementitious material binding to the strands without using an adhesive.

16. The panel of claim 15, wherein the water-resistant layer further includes a weather barrier on the outward-facing surface of the fiber-based carrier layer, wherein the weather barrier is impermeable to liquid (bulk) water ingress into the intermediate layer but is permeable to water vapor egress from the intermediate layer.

17. The panel of claim 16, wherein the weather barrier is a hydrophobic treatment coated onto the outward-facing surface of the fiber-based carrier layer, wherein the hydrophobic treatment is phenolic resin, melamine formaldehyde resin, acrylic or modified acrylic resin, or polyurethane dispersion selected for providing water-resistance properties.

18. The panel of claim 16, wherein the weather barrier is a sheet of material laminated, extruded, or adhered/bonded onto the outward-facing surface of the fiber-based carrier layer, wherein the sheet of material is thermoplastic polyurethane (TPU), polycarbonate (PC), PETG/co-polyester, acrylic (PMMA), rigid and/or flexible PVC, polyethylene, polypropylene, another polyolefin, another thermoplastic film, or a combination thereof, selected for having water-resistance properties.

19. The panel of claim 15, wherein the core layer includes multiple stacked core layers, including a first core layer and a second core layer, with a reinforcement layer between the first and second core layers, and with the divider layer between the second core layer and the intermediate layer.

20. A method of manufacturing the panel of claim 15, comprising:

laying down the water-resistant layer with the outward-facing surface facing downward, wherein the water-resistant layer includes the fiber-based carrier layer with a weather barrier secured to the outward-facing surface thereof and includes an opposite inner-facing surface uncoated to form an open backer with loose fiber strands extending therefrom, wherein the step of laying down the water-resistant layer further includes laying down the water-resistant layer with the open backer facing upward;

laying down a slurry of the cementitious material and the hydrophobic additive onto the water-resistant layer to form the intermediate layer, wherein the step of laying down the slurry of the cementitious material and hydrophobic additive further includes laying down the slurry of the cementitious material and hydrophobic additive onto the open backer of the fiber-based carrier layer to form the intermediate layer so that, upon curing of the panel, the loose fiber strands are embedded into the intermediate layer to secure the water-resistant layer to the intermediate layer;

laying down the divider layer onto the slurry of the cementitious material and hydrophobic additive;

laying down a slurry of the cementitious material and the aggregate material onto the divider layer to form the core layer; and curing the layers to form the panel.

* * * * *